United States Patent [19]

Coppin et al.

[11] Patent Number: 4,725,223

[45] Date of Patent: Feb. 16, 1988

[54] INCINERATOR BURNER ASSEMBLY

[75] Inventors: Willim P. Coppin; Tadeusz Karabin, both of Muncie, Ind.

[73] Assignee: Maxon Corporation, Muncie, Ind.

[21] Appl. No.: 909,683

[22] Filed: Sep. 22, 1986

[51] Int. Cl.[4] ..... F23D 11/44

[52] U.S. Cl. ..... 431/243; 431/115; 422/173; 422/182

[58] Field of Search ..... 431/242, 243, 166, 167, 431/115, 116; 422/168, 173, 182, 183; 60/303

[56] References Cited

U.S. PATENT DOCUMENTS

| | | | |
|---|---|---|---|
| 2,188,133 | 1/1940 | Hepburn | 126/91 |
| 2,880,079 | 3/1959 | Cornelius | 60/280 |
| 2,902,270 | 9/1959 | Salomonsson | 432/3 |
| 3,484,189 | 12/1969 | Hardison et al. | 431/243 |
| 3,688,760 | 9/1972 | Rudin | 126/91 |
| 4,047,881 | 9/1977 | Eschenauer et al. | 431/215 |
| 4,097,223 | 6/1978 | Garnier | 431/191 |
| 4,098,255 | 7/1978 | Nowak | 126/91 |
| 4,140,482 | 2/1979 | Simon | 432/209 |
| 4,255,124 | 3/1981 | Baranowski, Jr. | 431/353 |
| 4,310,303 | 1/1982 | Collier | 432/209 |
| 4,401,099 | 8/1983 | Collier | 126/91 |
| 4,416,613 | 11/1983 | Barisoff | 431/243 |
| 4,480,986 | 11/1984 | Nelson et al. | 431/243 |
| 4,676,736 | 6/1987 | Alpqvist | 431/243 |

FOREIGN PATENT DOCUMENTS

| | | |
|---|---|---|
| 2165172 | 7/1972 | Fed. Rep. of Germany . |
| 2243314 | 3/1974 | Fed. Rep. of Germany . |
| 52-57551 | 5/1977 | Japan . |
| 1479144 | 7/1977 | United Kingdom . |

*Primary Examiner*—Carroll B. Dority, Jr.
*Attorney, Agent, or Firm*—Robert M. Ward

[57] ABSTRACT

The improved incinerator apparatus of the present invention is particularly applicable in the purification of air contaminated with volatilized solvents, and functions through the use of a venturi within the assembly which imposes a low pressure drop while simultaneously obtaining a high degree of turbulence and mixing of the primary fuel with the effluent waste gas being incinerated. The incinerator apparatus of the present invention comprises a solvent vapor conduit for directing a stream of air containing solvent vapors in a first longitudinal direction to be redirected into a venturi. The venturi is preferably disposed within the solvent vapor conduit. A supplemental fuel injector is disposed within the central bore of the venturi to provide gaseous fuel through the central bore to comingle with the solvent vapor containing air for ignition, to provide a sustainable flame for burning the volatilized solvent in the air and thereby to provide air free of such solvent vapors. In preferred embodiments, the sustainable flame also serves to preheat the solvent vapor conduit to provide a preheated stream of solvent containing air for greater efficiency of burning. The net result of the incinerator apparatus of the present invention is to provide sufficient time, temperature and turbulence for removing the volatiles from the air by means of incineration, while simultaneously imposing a low pressure drop upon the apparatus.

15 Claims, 2 Drawing Figures

INCINERATOR BURNER ASSEMBLY

BACKGROUND OF THE DISCLOSURE

The present invention is generally directed to incinerators, and more particularly to an improved incinerator apparatus for removing volatilized solvents from a stream of contaminated air.

In certain industrial processes, particularly including the automotive and heavy equipment industries, the use of solvent-based paints is the frequent practice. Increasingly in recent years, government regulations have dictated that the levels of solvent vapors escaping from such operations, both into the atmosphere surrounding such businesses and in the plant near the process concerned, shall for the safety employees be held at minimum levels. With further reduced minimum levels, it has been difficult to meet such regulations without the necessity for expensive and difficult to maintain equipment. Although these prior art air cleaning systems have in some respects been satisfactory, improvement has been necessitated for the aforesaid reasons.

Accordingly, in view of the above defects and deficiencies of the prior art, it is an object of the present invention to provide an improved incinerator apparatus for removing volatilized solvents from a stream of air, and to do so at reduced cost and enhanced efficiency.

It is also an object of the improved incinerator apparatus of the present invention to provide apparatus which will, with but low pressure drop across a venturi structure, provide sufficient temperature to the solvent contaminated air stream, sufficient turbulence to such stream, and sufficient time of positioning within a sustained flame to incinerate the volatiles from such air stream, thereby to decontaminate the air stream from such volatilized solvents.

SUMMARY OF THE INVENTION

The improved incinerator apparatus of the present invention substantially ameliorates the above difficulties by providing structure to effectuate the time, temperature and turbulence considerations necessary to incinerate the volatilized solvents within the air stream.

The improved incinerator apparatus of the present invention comprises a solvent vapor conduit for directing a stream of air containing solvent vapors in a first longitudinal direction to be redirected into a venturi. The venturi is disposed within the solvent vapor conduit. A supplemental fuel injector is disposed within the central bore of the venturi to provide gaseous fuel through the central bore to comingle with the air containing such solvent vapors for ignition, to provide a sustainable flame for burning the volatilized solvent in the air, and thereby to provide air free of such solvent vapors.

In preferred embodiments, the sustainable flame also serves to preheat the solvent vapor conduit to provide a preheated stream of air containing such solvent vapors for greater efficiency of burning. The net result of the incinerator apparatus of the present invention is to provide sufficient time, temperature and turbulence for removing the volatiles from the air by means of incineration.

In preferred emodiments, the various elements of the improved incinerator apparatus of the present invention comprise a series of concentric cylindrical shaped vessels all of which are disposed within the solvent vapor conduit to provide a compact unit requiring only a minimum of additional space greater than that required for the solvent vapor conduit itself.

The functioning of the elements of the improved incinerator apparatus of the present invention to effectuate the desired purposes thereof will be better understood by those of ordinary skill in the art upon review of the following brief description of the drawing, detailed description of preferred embodiments, appended claims and accompanying drawing.

BRIEF DESCRIPTION OF THE DRAWING

The improved incinerator apparatus of the present invention is depicted in the accompanying drawing, and in which.

DETAILED DESCRIPTION OF PREFERRED EMBODIMENTS

Figure 1:
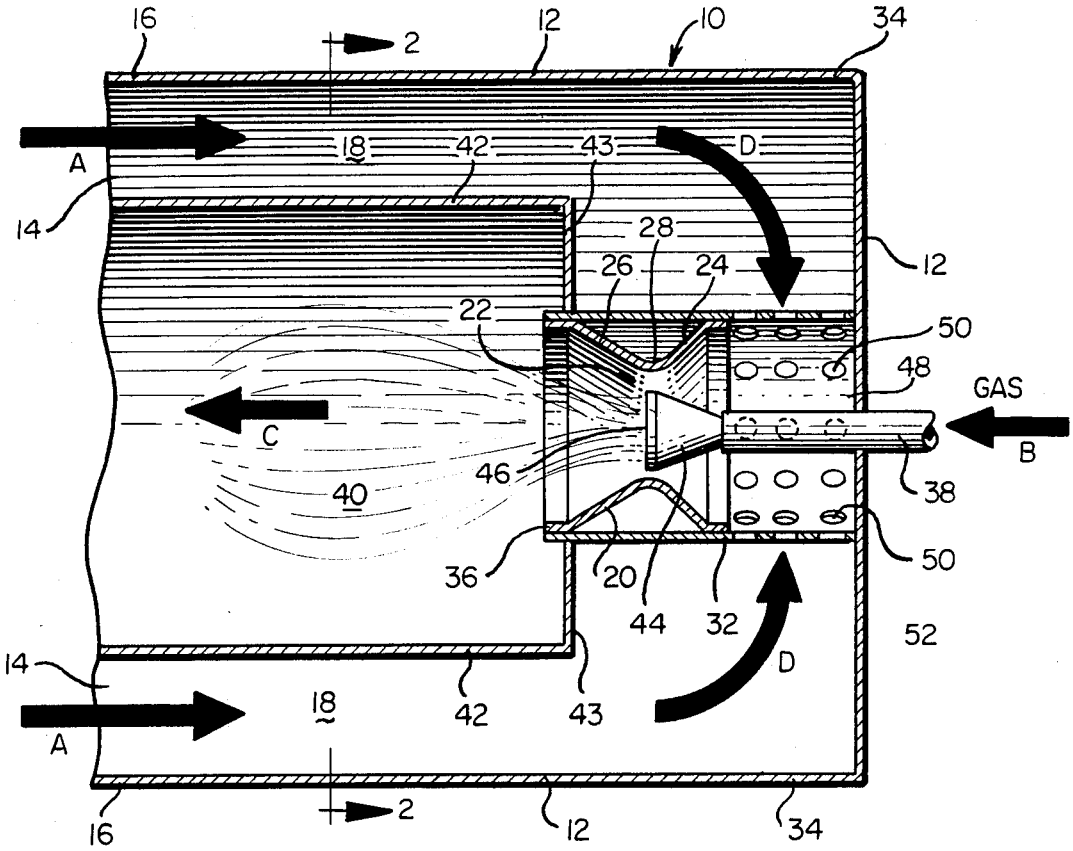
FIG. 1 is a longitudinal cross-sectional view of the incinerator apparatus of the present invention, and showing the solvent vapor conduit for directing a stream of solvent vapor in air in a first longitudinal direction, and directing the stream of solvent vapor in air into a venturi structure to join the flow in a second longitudinal direction of a sustainable flame sustained by injection of a gaseous fuel from an external source.

The improved incinerator apparatus of the present invention for decontaminating a stream of air containing volatilized solvents includes a solvent vapor conduit means for transporting a stream of solvent vapor in air in a first longitudinal direction. The solvent conduit means includes a solvent vapor entry means at a distal portion thereof. A venturi means is provided and includes a converging and then diverging central bore means joined at a constricted portion. The venturi means is disposed within the solvent vapor conduit means and includes a solvent vapor influent end disposed near a proximal portion of the solvent vapor conduit means. The venturi means further includes a solvent vapor effluent end disposed at an opposite end of the venturi means.

Supplemental fuel injection means are disposed substantially concentrically within the central bore of the venturi means for directing a supplemental gaseous fuel through the central bore of the venturi means substantially in a second longitudinal direction to comingle with substantial turbulence with the solvent vapor in air, to provide sufficient gaseous fuel for combustion of the solvent vapor in a sustainable flame, and such flame also being in a direction generally opposite that of said first longitudinal direction.

Flame containing means is also provided, and which is preferably connected to the solvent vapor effluent end of the venturi means. Such flame containing means is disposed within the solvent vapor conduit means for providing preheating to the stream of solvent vapor in air.

In preferred embodiments of the volatilized solvent incinerator apparatus of the present invention, the solvent vapor conduit means is substantially cylindrical in configuration. The flame containing means preferably is substantially cylindrical in shape. Also, the flame containing means is preferably disposed substantially concentrically with respect to the solvent vapor conduit means.

The supplemental fuel injection means in preferred embodiments further comprises diverging nozzle means for directing the supplemental gaseous fuel in a diverging flow generally conforming to the diverging portion of the central bore of the venturi means. Such diverging nozzle may preferably include an orifice opening into the venturi central bore substantially at the constriction portion thereof. Such diverging nozzle means is disposed substantially concentric with the solvent vapor conduit means.

The improved incinerator apparatus of the present invention further preferably comprises ventilated entry means for directing the stream of solvent vapor in air into the converging portion of the central bore means of the venturi means. The flame containing means sealingly confines the flame therein from the stream of solvent vapor in air and is preferably disposed within the solvent vapor conduit means.

The ventilated entry means comprises a wall surface which is substantially cylindrical in shape. Such wall surface of the cylindrical ventilated entry means contains a plurality of apertures therein for entry of portions of the stream of solvent vapor in air thereinto for flow through the venturi means for combusion within the flame containing means. The cylinder of the ventilated means is of a size and shape substantially congruent with that of the influent end of the venturi means.

Referring now to the drawing and to FIG. 1 thereof in particular, the improved incinerator apparatus of the present invention generally 10 is provided for decontaminating a stream of air containing volatilized solvents designated at arrows A,A thereof. Such improved incinerator apparatus 10 includes a solvent vapor conduit 12 for transporting the stream of solvent vapor in air A,A in the first longitudinal direction as depicted by arrows A,A. The solvent vapor conduit 12 includes a solvent vapor entry portion 14 at a distal portion 16 thereof forming a conductive channel 18 within vapor conduit 12. A venturi 20 is provided and includes a central bore 22 having a converging portion 24 and a diverging portion 26 joined at a constricted portion 28.

The venturi 20 is disposed within solvent vapor conduit 12. Venturi 20 further includes solvent vapor effluent end 36 disposed at an opposite end of venturi means 20. A supplemental fuel injection conduit 38 is disposed substantially concentrically within central bore 22 of venturi 20 for directing in the direction of arrow B a supplemental gaseous fuel through central bore 22 of venturi 20. Such direction of arrow B is substantially in a second longitudinal direction and the supplemental gaseous fuel comingles with substantial turbulence with the solvent vapor in air to provide sufficient gaseous fuel for combustion of the solvent vapor in a sustainable flame 40, and such flame 40 also disposed in a direction as shown at arrow C generally opposite that of said first longitudinal direction A,A.

Flame containing walls 42 are also provided and which are preferably connected to solvent vapor effluent end 36 of venturi 20 by means of end elements 43 and are disposed within solvent vapor conduit 12 for providing preheating to the stream of solvent vapor in air as contained within the conductive channel 18.

Figure 2:
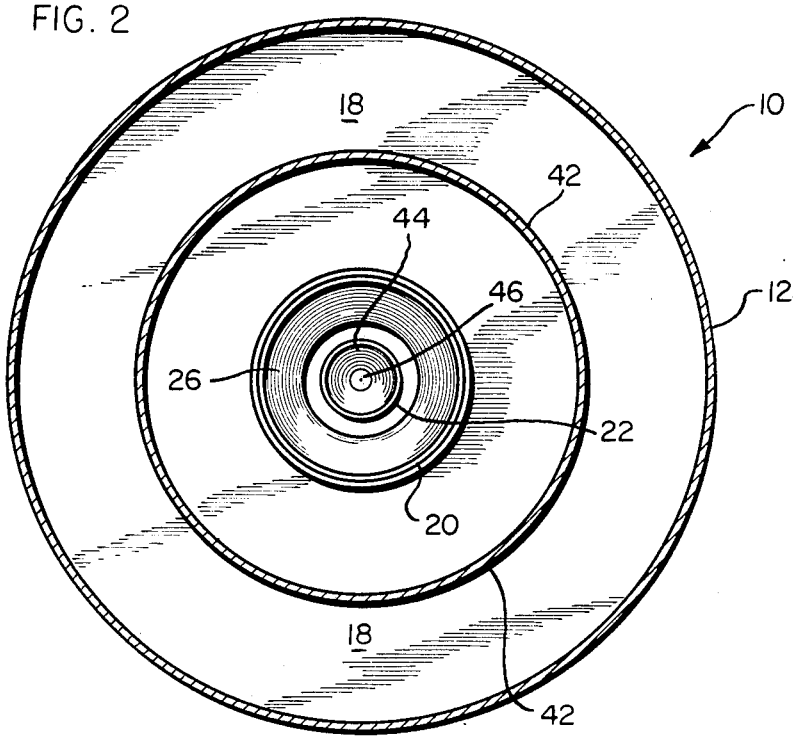
FIG. 2 is a transverse cross-sectional view taken along lines 2—2 in FIG. 1 and showing the concentrically disposed solvent vapor conduit, flame containing means, venturi, and supplemental fuel injection nozzle.

In preferred embodiments of the volatilized solvent incinerator apparatus 10 of the present invention, the solvent vapor conduit 12 is substantially cylindrical in configuration as shown in FIGS. 1 and 2. The flame containing walls 42 preferably are also substantially cylindrical in shape as shown in FIGS. 1 and 2. Also, flame containing walls 42 are preferably disposed substantially concentrically with respect to solvent vapor conduit 12, as shown particularly in FIG. 2.

The supplemental fuel injection conduit 38 in preferred embodiments further comprises a diverging nozzle 44 for directing the supplemental gaseous fuel in a diverging flow generally conforming to diverging portion 26 of central bore 22 of the venturi 20. Such diverging nozzle 44 may preferably include an orifice 46 opening into venturi central bore 22 substantially at constricted portion 28 thereof. Such diverging nozzle 44 is disposed substantially concentrically with respect to solvent vapor conduit 12 as also is particularly shown at FIG. 2 hereof.

The improved incinerator apparatus 10 of the present invention further preferably comprises a ventilated entry collar 48 having a plurality of apertures 50 therein for directing the stream of solvent vapor in air from solvent vapor conduit 12 as shown by arrows D,D thereinto and therefrom into converging portion of central bore 22 of venturi 20. Flame containing walls 42 sealingly confine flame 40 therein from the stream of solvent vapor in air as contained in conductive channel 18. Ventilated entry collar 48 comprises a wall surface 52 which is substantially cylindrical in shape as shown in FIG. 1. Such wall surface 52 of cylindrical ventilated entry collar 48 contains the plurality of apertures 50 therein for entry of portions of the stream of solvent vapor in air thereinto for flow through venturi 20 for combustion within flame containing walls 42. The cylinder of the ventilated entry collar 48 is of a size and shape substantially congruent with that of vapor influent end 32 of venturi 20.

One particular advantage of the functioning of improved incinerator apparatus 10 utilizing venturi 20 as shown in FIGS. 1 and 2 hereof is to impose but a low pressure drop across the system, while at the same time obtaining a high degree of turbulence and mixing of the supplemental fuel (A now B) injected through orifice 46 at or near constricted portion 28 of venturi 20, such mixing with the solvent vapor in the air stream flowing through central bore 22 of venturi 20 for efficient burning thereof in flame 40.

Although a wide variety of burners may be utilized in regard to the present invention according to the knowledge of those of ordinary skill in the art and without undue experimentation being necessary, one burner found to have applicability for present purposes is rated at 3,000,000 B.T.U. capacity, operates at approximately 0.2 inches water column pressure, with approximately 0.5–2.0 inches water column pressure across the burner and utilizable in a stream of air having as low as 16% oxygen.

The basic and novel characteristics of the improved apparatus of the present invention will be readily understood from the foregoing disclosure by those skilled in the art. It will become readily apparent that various changes and modifications may be made in the form, construction and arrangement of the improved apparatus of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. An improved volatilized solvent incinerator apparatus having a sustainable flame, said apparatus comprising:

solvent vapor conduit means for transporting a stream of solvent vapor in an air stream in a first longitudinal direction therein, said solvent vapor conduit means having solvent vapor entry means at a distal portion thereof, said solvent vapor conduit means defining flame containing means for containing the flame substantially disposed within said solvent vapor conduit means for providing preheating to the stream of solvent vapor in the air stream;

venturi means having converging and diverging central bore means thereof joining at a contricted portion, disposed within said solvent vapor conduit means, having a solvent vapor influent end disposed near a proximal portion of said solvent vapor conduit means, and having a vapor effluent end disposed at an opposite end of said venturi means; and supplemental gaseous fuel injection means disposed within said central bore of said venturi means for directing supplemental gaseous fuel through the central bore of said venturi means substantially in a second longitudinal direction and through said orifice thereof to comingle with substantial turbulence the solvent vapor in the air stream to provide sufficient gaseous fuel for combustion of the solvent vapor in the sustainable flame which is directed generally also in the second longitudinal direction, said supplemental gaseous fuel injection means including an orifice having a substantial diameter suitable for discharging sufficient gaseous fuel therethrough to sustain the flame for combustion of such solvent vapor, said supplemental fuel injection means further including diverging nozzle means for directing the supplemental gaseous fuel in a diverging flow generally conforming to the diverging portion of the central base of said venturi means;

whereby such venturi means impose a low pressure drop upon said apparatus while simultaneously providing substantial turbulence and mixing of the supplemental fuel with the solvent vapor being incinerated to reduce the level of the solvent vapor within the air stream.

2. The improved volatilized solvent incinerator apparatus of claim 1 wherein said solvent vapor conduit means is substantially cylindrical in configuration.

3. The improved volatilized solvent incinerator apparatus of claim 1 wherein said flame containing means is substantially cylindrical in configuration.

4. The improved volatilized solvent incinerator apparatus of claim 3 wherein said flame containing means is disposed substantially concentrically with said solvent vapor conduit means.

5. The improved volatilized solvent incinerator apparatus of claim 1 wherein said diverging nozzle means includes an orifice opening into said venturi central bore substantially at the constricted portion thereof.

6. The improved volatilized solvent incinerator apparatus of claim 1 wherein said diverging nozzle means is substantially concentric with said solvent vapor conduit means.

7. The improved volatilized solvent incinerator apparatus of claim 1 further comprising ventilated entry means for directing the stream of solvent vapor in air into said converging portion of said central bore means of said venturi means.

8. The improved volatilized solvent incinerator apparatus of claim 7 wherein said ventilated entry means comprises a wall surface which is substantially cylindrical in shape.

9. The improved volatilized solvent incinerator apparatus of claim 8 wherein the wall surface of said cylindrical ventilated entry means contains a plurality of apertures therein for entry of portions of the stream of solvent vapor in air thereinto for flow through said venturi means for combustion within said flame containing means.

10. The improved volatilized solvent incinerator apparatus of claim 8 wherein the cylinder of said ventilated entry means is of a size and shape substantially congruent with that of said influent end of said venturi means.

11. The improved volatilized solvent incinerator apparatus of claim 1 wherein said flame containing means is connected to said solvent vapor effluent end of said venturi means.

12. The improved volatilized solvent incinerator apparatus of claim 1 wherein said supplemental gaseous fuel injection means is disposed substantially concentrically within said central bore of said venturi means.

13. The improved volatilized solvent incinerator apparatus of claim 1 further comprising substantially unobstructed path for discharge of such comingled gaseous fuel with such solvent vapor in the air stream from said central bore of said venturi.

14. The improved volatilized solvent incinerator apparatus of claim 1 wherein substantially the entirety of the solvent vapor in air stream is directed through said venturi.

15. An improved volatilized solvent incinerator apparatus having a sustainable flame, said apparatus comprising:

solvent vapor conduit means for transporting a stream of solvent vapor in an air stream in a first longitudinal direction therein, said solvent vapor conduit means having solvent vapor entry means at a distal portion thereof, said solvent vapor conduit means defining flame containing means for containing the flame substantially disposed within said solvent vapor conduit means for providing preheating to the stream of solvent vapor in the air stream;

venturi means having converging and diverging central bore means thereof joining at a constricted portion, disposed within said solvent vapor conduit means, having a solvent vapor influent end disposed near a proximal portion of said solvent vapor conduit means, and having a vapor effluent end disposed at an opposite end of said venturi means, said venturi means having said flame containing means sealingly connected thereto; and supplemental gaseous fuel injection means disposed within said central bore of said venturi means for directing supplemental gaseous fuel through the central bore of said venturi means substantially in a second longitudinal direction and through said orifice thereof to comingle with substantial turbulence the solvent vapor in the air stream to provide sufficient gaseous fuel for combustion of the solvent vapor in the sustainable flame which is directed generally also in the second longitudinal direction; and whereby such venturi means impose a low pressure drop upon said apparatus while simultaneously providing substantial turbulence and mixing of the supplemental fuel with the solvent vapor being incinerated to reduce the level of the solvent vapor within the air stream.

* * * * *